US005535686A

United States Patent [19]

Chung

[11] Patent Number: 5,535,686

[45] **Date of Patent: *Jul. 16, 1996**

[54] BURNER FOR TANGENTIALLY FIRED BOILER

[76] Inventor: Landy Chung, 2116 Morningside Dr., Ashtabula, Ohio 44004

[ * ] Notice: The term of this patent shall not extend beyond the expiration date of Pat. No. 5,249,535.

[21] Appl. No.: 380,831

[22] Filed: Jan. 30, 1995

Related U.S. Application Data

[63] Continuation-in-part of Ser. No. 218,465, Mar. 28, 1994, Pat. No. 5,388,536, which is a continuation of Ser. No. 99,104, Jul. 29, 1993, abandoned, which is a continuation-in-part of Ser. No. 995,942, Dec. 21, 1992, Pat. No. 5,249,535, which is a continuation of Ser. No. 856,234, Mar. 25, 1992.

[51] Int. Cl.[6] ..... F23D 1/02

[52] U.S. Cl. ..... 110/264; 110/347; 239/502; 431/183

[58] Field of Search ..... 110/263, 264, 110/347; 431/182, 183, 184; 239/500, 501, 502

[56] References Cited

U.S. PATENT DOCUMENTS

| | | |
|---|---|---|
| 1,527,214 | 2/1925 | Peabody . |
| 1,628,424 | 5/1927 | Peabody . |
| 1,870,013 | 8/1932 | Keenan, Jr. . |
| 1,995,934 | 3/1935 | Mangold . |
| 2,320,576 | 6/1943 | Dunn . |
| 2,480,547 | 8/1949 | Caracristi . |
| 2,525,432 | 10/1950 | Stadler . |
| 2,815,069 | 12/1957 | Garraway . |
| 2,838,103 | 6/1958 | Voorheis . |
| 2,889,871 | 6/1959 | Voorheis . |
| 3,145,670 | 8/1964 | Copian et al. . |
| 3,411,716 | 11/1968 | Stephan et al. . |
| 3,743,471 | 7/1973 | Jaeger . |
| 3,944,142 | 3/1976 | Welden et al. . |
| 4,050,632 | 9/1977 | Wyse . |
| 4,087,050 | 5/1978 | Tsuji et al. . |
| 4,089,637 | 5/1978 | Smith et al. . |
| 4,150,631 | 4/1979 | Frey et al. . |
| 4,223,615 | 9/1980 | Breen et al. . |

(List continued on next page.)

FOREIGN PATENT DOCUMENTS

| | | |
|---|---|---|
| 233901 | 1/1960 | Australia . |
| 339844 | 3/1918 | Germany . |
| 958907 | 5/1964 | United Kingdom . |

OTHER PUBLICATIONS

"Current Developments in Low $NO_x$ Firing Systems" Published by Combustion Engineering, Inc., Oct. 1980.

"Large Burners and Low $NO_x$", Foster Wheeler Energy Corporation Brochure, Published 1979.

EPRI Journal, Published Nov. 1984 by Electric Power Research Institute, Inc. *pp. 26 through 33*.

"C–E Wide–Range Coal Nozzle" Information Bulletin Published by Combustion Engineering, Bearing a Copyright Notice of 1985.

*Primary Examiner*—Thomas E. Denion

*Attorney, Agent, or Firm*—Watts, Hoffmann, Fisher & Heinke

[57] ABSTRACT

A low nox burner for use in a tangentially-fired furnace having a pivotally mounted burner tip attached to a fuel passage that in operation, conveys pulverized coal carried by an airstream. The burner tip includes a plurality of first and second blade members extending substantially radially from a centrally positioned, cone-shaped support member. A fuel guide surrounds and is attached to the outer ends of the first and second blade members thereby defining alternating fuel-rich and fuel-lean channels between the centrally positioned support member and inside of the fuel guide. An air guide surrounds the fuel guide and defines a passage for combustion air which is received from an air housing. The position of the air guide with respect to the fuel guide is maintained by a plurality of angled vanes which are operative to impart rotational forces to the combustion air traveling between the air guide and the fuel guide.

28 Claims, 5 Drawing Sheets

U.S. PATENT DOCUMENTS

| | | | |
|---|---|---|---|
| 4,253,403 | 3/1981 | Vatsky . | |
| 4,348,170 | 9/1982 | Vatsky et al. . | |
| 4,368,031 | 1/1983 | Chadshay | 431/79 |
| 4,400,151 | 8/1983 | Vatsky . | |
| 4,457,241 | 7/1984 | Itse et al. . | |
| 4,504,216 | 3/1985 | Hagar et al. . | |
| 4,520,739 | 6/1985 | McCartney et al. | 110/263 |
| 4,681,532 | 7/1987 | Chung . | |
| 4,927,352 | 5/1990 | Chung . | |
| 4,930,430 | 6/1990 | Allen et al. | 110/347 |
| 5,020,454 | 6/1991 | Hellewell et al. . | |
| 5,113,771 | 5/1992 | Rini et al. . | |
| 5,146,858 | 9/1992 | Tokuda et al. . | |
| 5,249,535 | 10/1993 | Chung . | |
| 5,365,865 | 11/1994 | Monro | 110/347 |
| 5,388,536 | 2/1995 | Chung | 110/264 |

BURNER FOR TANGENTIALLY FIRED BOILER

CROSS REFERENCE TO RELATED APPLICATIONS

This is a continuation-in-part patent application of U.S. Ser. No. 08/218,465, filed Mar. 28, 1994, now U.S. Pat. No. 5,388,536, which is a continuation of U.S. Ser. No. 08/099,104, filed Jul. 29, 1993, now abandoned, which is a continuation-in-part of U.S. Ser. No. 07/995,942, filed Dec. 21, 1992, now U.S. Pat. No. 5,249,535, and which is a continuation of U.S. Ser. No. 07/856,234, filed Mar. 25, 1992, now abandoned.

TECHNICAL FIELD

The present invention relates generally to industrial furnaces and/or boilers which burn pulverized coal, and more specifically, to an improved coal burner which reduces the formation of nitrogen oxides during the combustion process.

BACKGROUND

Recently, considerable attention and efforts have been directed to the reduction of nitrogen oxides resulting from the combustion of fuel. This is especially true in the area of large furnaces or boilers such as used by the power generation utilities which utilize coal as their main fuel source. In a typical arrangement for burning coal in a large boiler, several burners are disposed in communication with the interior of the boiler and operate to burn a mixture of air and pulverized coal. The burners used in these arrangements are generally of the type in which a fuel-air mixture is continuously injected through a nozzle so as to form a single, relatively large flame. As a result, the surface area of the flame is relatively small in comparison to its volume, and therefore, the average flame temperature is relatively high. However, in the burning of coal, nitrogen oxides are formed due to the reaction of nitrogen present in the combustion-supporting air with oxygen. The formation of nitrous oxides is a function of flame temperature. When the flame temperature exceeds 2800° F., the amount of nitrogen removed from the combustion-supporting air rises exponentially with increases in the temperature. This condition leads to the production of high levels of nitrogen oxides in the final combustion products, which is undesirable.

Nitrogen oxides are also formed from the fuel bound nitrogen available in the fuel itself, which is not a direct function of the flame temperature, but is related to the quantity of available oxygen during the combustion process.

Low Nox burners for use in power or utility boilers are now available for certain types of furnaces. For example, U.S. Pat. No. 5,249,535 illustrates an example of such a burner. The burner disclosed in this U.S. patent, however, is not suitable for use in a tangentially-fired furnace. In a tangentially-fired furnace, burners are usually located at each corner of a square-shaped combustion chamber. The axes of the burners are offset with respect to a central axis of the combustion chamber and are generally tangent to an imaginary cylinder which defines a combustion zone where a fireball is generated during operation of the burners. Since many utility boilers are heated by a tangentially-fired furnace, it is desirable to provide a burner capable of low nox emissions for these types of furnaces.

DISCLOSURE OF THE INVENTION

The present invention provides a new and improved burner that is suitable for use in an tangentially fired furnace.

The burner includes structure defining a fuel passage or conduit that extends between a fuel inlet to a fuel passage outlet and which is preferably positioned within an air housing forming part of the burner assembly. In the disclosed embodiment, the fuel passage conveys fuel in the form of pulverized coal carried by an air stream.

A burner tip is attached to the fuel passage outlet and includes a fuel stream dividing unit which divides the pulverized coal stream into fuel rich and fuel lean streams. The fuel stream dividing unit includes a plurality of first blade members that extend generally radially from a center support member and which are spaced about the support member. A plurality of second blade members are also spaced circumferentially about the center support member but in an alternating relationship with the first blade members.

The first blade members are positioned at a first angle with respect to a center line of the burner tip. The second blade members are positioned at a second angle with respect to the axis of the burner tip. The configuration of alternating first and second blade members defines alternating fuel lean and fuel rich channels. The fuel rich channel converges in cross-section between adjacent first and second blade members whereas the fuel lean channel diverges in cross-section between adjacent second blade and first blade members.

In the preferred and illustrated embodiment, the burner tip is pivotally attached to the outlet of the fuel passage and is preferably rotatable about a horizontal axis.

According to a feature of the invention, the periphery of the first and second blade members are surrounded by a fuel guide or shroud. In the illustrated embodiment, the fuel guide tapers inwardly to form a necked or narrow diameter portion downstream of the first and second blade members. A portion expanding outwardly extends from the neck portion to defined a larger diameter outlet for the fuel stream.

In accordance with the preferred embodiment, an air guide surrounds the fuel guide and defines a path for secondary air in the form of an annular channel defined between the outside of the fuel guide and the inside of the air guide. A plurality of supports maintain the position of the air guide with respect to the fuel guide. The outside surface of the expanding portion of the fuel guide serves as a deflecting member which causes the secondary air travelling along the air guide channel to be deflected outwardly with respect to the center line of the burner tip.

In the preferred and illustrated embodiment, the air guide supports positioned between the outer air guide and the fuel guide act as vanes. The vanes impart rotation to the secondary air travelling in the annular passage defined between the fuel conduit and the inside of the air housing.

In the preferred embodiment, the air guide is rigidly attached to the fuel guide by the secondary air vanes such that both members pivot as a unit about the horizontal pivot axis.

According to another feature of the invention, the first and second blade members are attached, at their inner ends, to a tapered center support member which preferably is in the form of a cone that tapers outwardly. The cone defines an arcuate ramp surface between adjacent first and second members which induce controlled turbulence in the fuel rich and lean fuel streams and thus stabilize the flame. The centrally positioned support cone also generates a centrally positioned fuel lean stream since it expands outwardly as the fuel stream traverses towards the outlet of the burner tip.

With the present invention, a low nox burner is provided that is especially suited for a tangentially fired furnace or boiler. The pivotally mounted burner tips enable adjustments in the flames in the vertical direction which is desirable in a tangentially fired furnace.

Additional features of the invention will become apparent and a fuller understanding obtained by reading the following detailed description made in connection with the accompanying drawings.

BEST MODE FOR CARRYING OUT THE INVENTION

Figure 1:
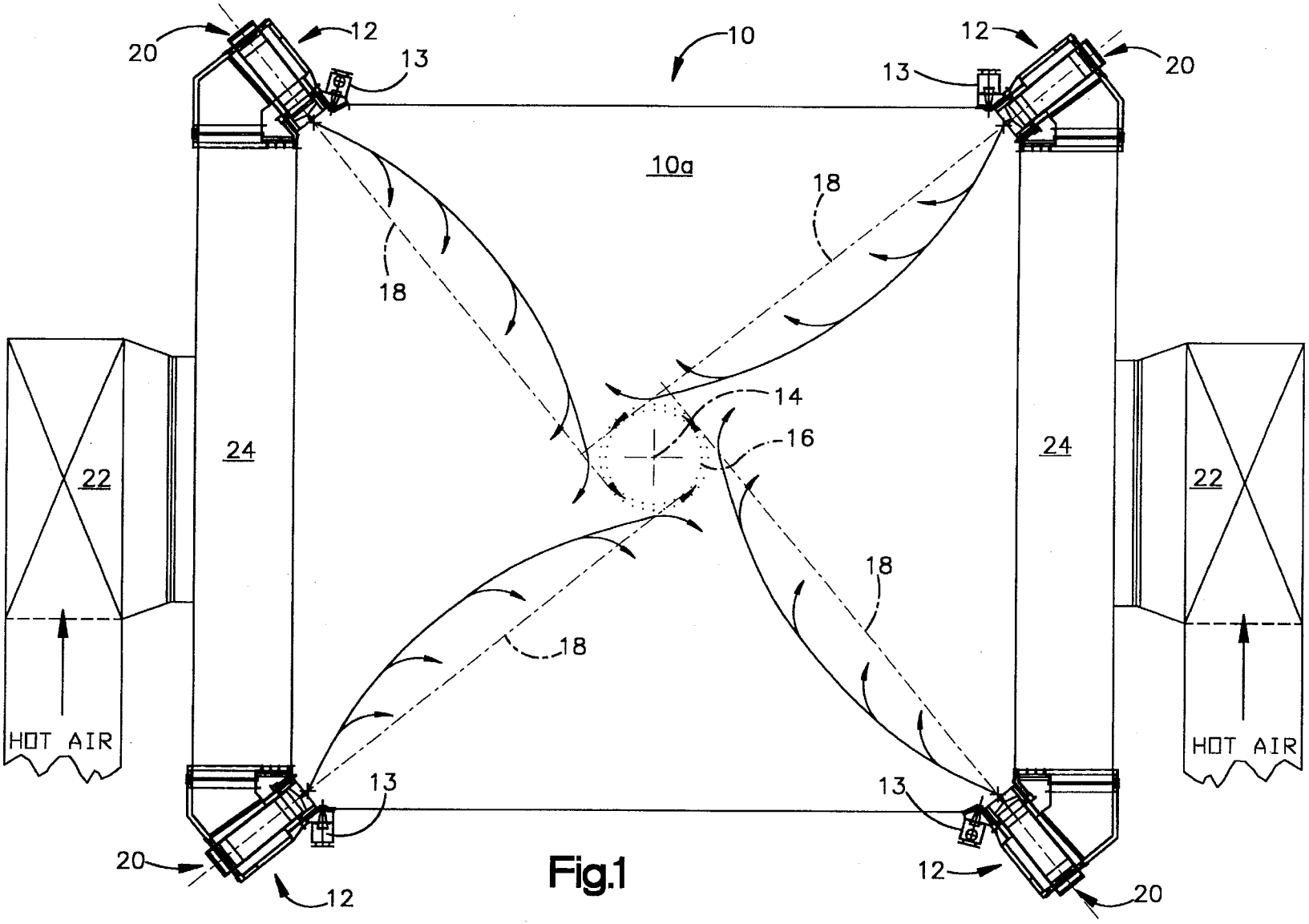
FIG. 1 is a schematic, plan view of a tangentially fired boiler incorporating low nox burners constructed in accordance with a preferred embodiment of the invention.

FIG. 1 illustrates, somewhat schematically, a tangentially fired combustion chamber 10*a* forming part of a boiler or furnace 10. This type of boiler is commonly used by power station companies to produce steam for driving steam turbines attached to electrical generators. A burner 12 is positioned at each corner of the combustion chamber 10*a*. Conventional ignitors 13 are positioned adjacent each burner 12. An axis 18 of each burner is offset slightly from a center axis 14 of the combustion chamber 10*a*. In fact, the axis 18 of each burner is preferably tangent to an imaginary cylinder 16. The cylinder defines a region in which a rotating fire ball is generated during operation of the boiler due to the tangential positioning of the burners 12. Each burner 12 injects fuel and combustion air into the combustion chamber, generally in the direction of the axes 18 of the respective burners 12.

A fuel source is connected to each burner by way of an inlet indicated generally by the reference characters 20. Combustion air is provided from a combustion air source (not shown) which is communicated to each burner 12 via air boxes 22 and combustion air channels 24 (which may also be referred to as "wind boxes"). The positioning of the burners and the means by which fuel and combustion air is communicated to the burners is considered conventional.

Figure 2:
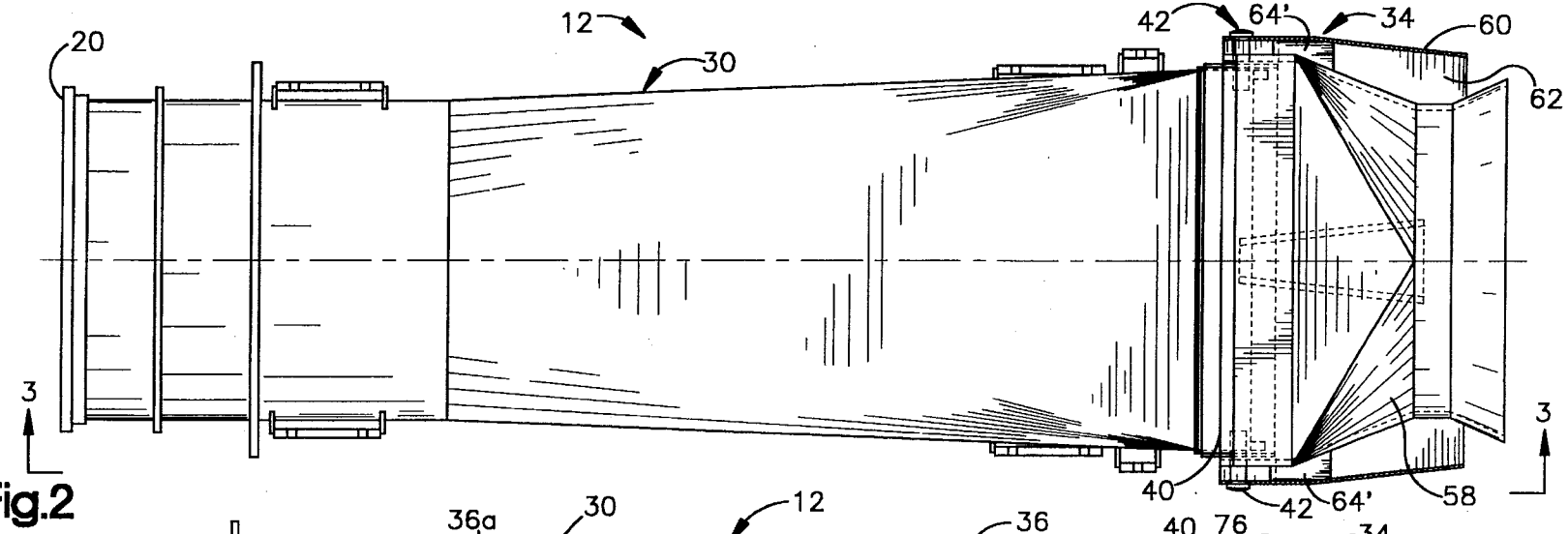
FIG. 2 is a top plan view of a burner with housing portions removed to show detail.
Figure 3:
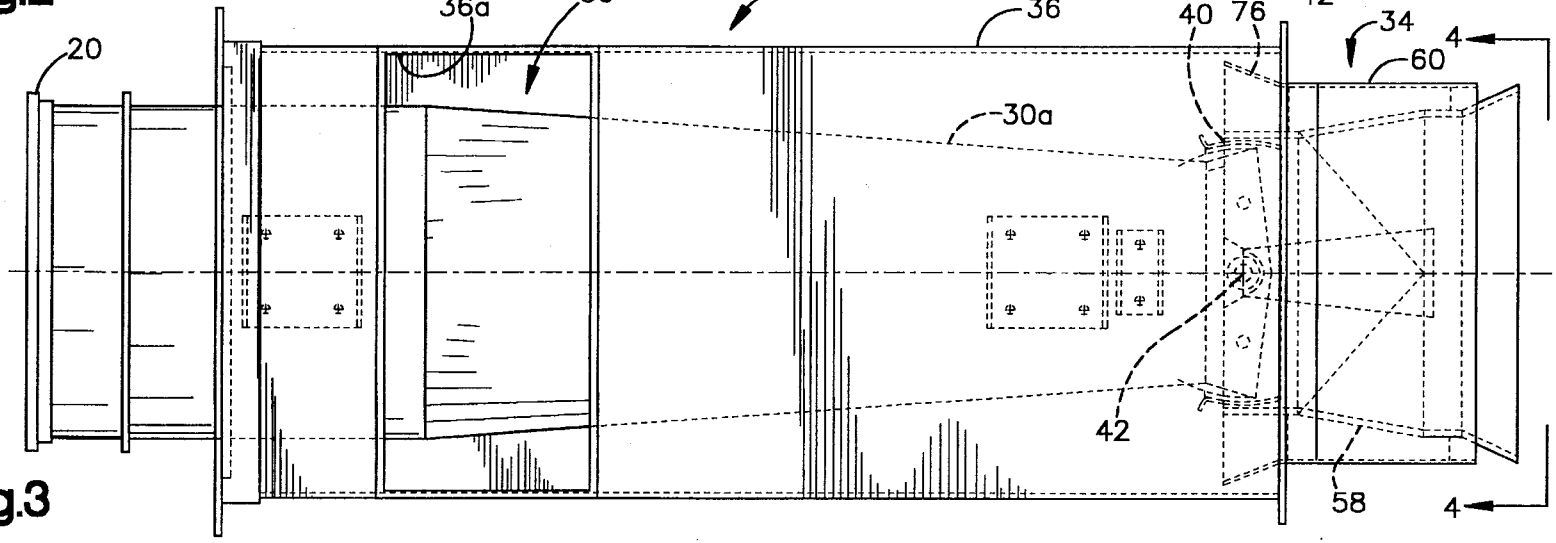
FIG. 3 is side elevational view of the burner shown in FIG. 2 as seen from the plane indicated by the line 3—3 in FIG. 2.

Turning now to FIGS. 2 and 3, a burner 12 constructed in accordance with the preferred embodiment of the invention is illustrated. The burner includes a fuel conduit member 30 which defines a fuel passage that extends from the fuel inlet 20 to a burner tip 34. The burner illustrated in FIG. 2 is adapted to burn coal which is conveyed through the fuel conduit member 30 as a pulverized coal stream that is a mixture of pulverized coal and air.

As seen in FIGS. 2 and 3, the inlet 20 is generally circular and is connected to a conventional fuel pipe (not shown) which connects the source of pulverized coal with the burner. Combustion air from the combustion air channels 24 (shown in FIG. 1) is also injected into the combustion chamber 10*a* via the burner tip 34.

As shown in FIG. 3, an air housing 36 surrounds and is spaced form the fuel conduit 30. Combustion or secondary air from the air channels or windboxes 24 is communicated to a burner 12 via opening 36*a* in the air housing 36. Combustion air is admitted to the region defined between the fuel conduit member 30 and the inside of the air housing 36 through the opening 36*a*.

Figure 4:
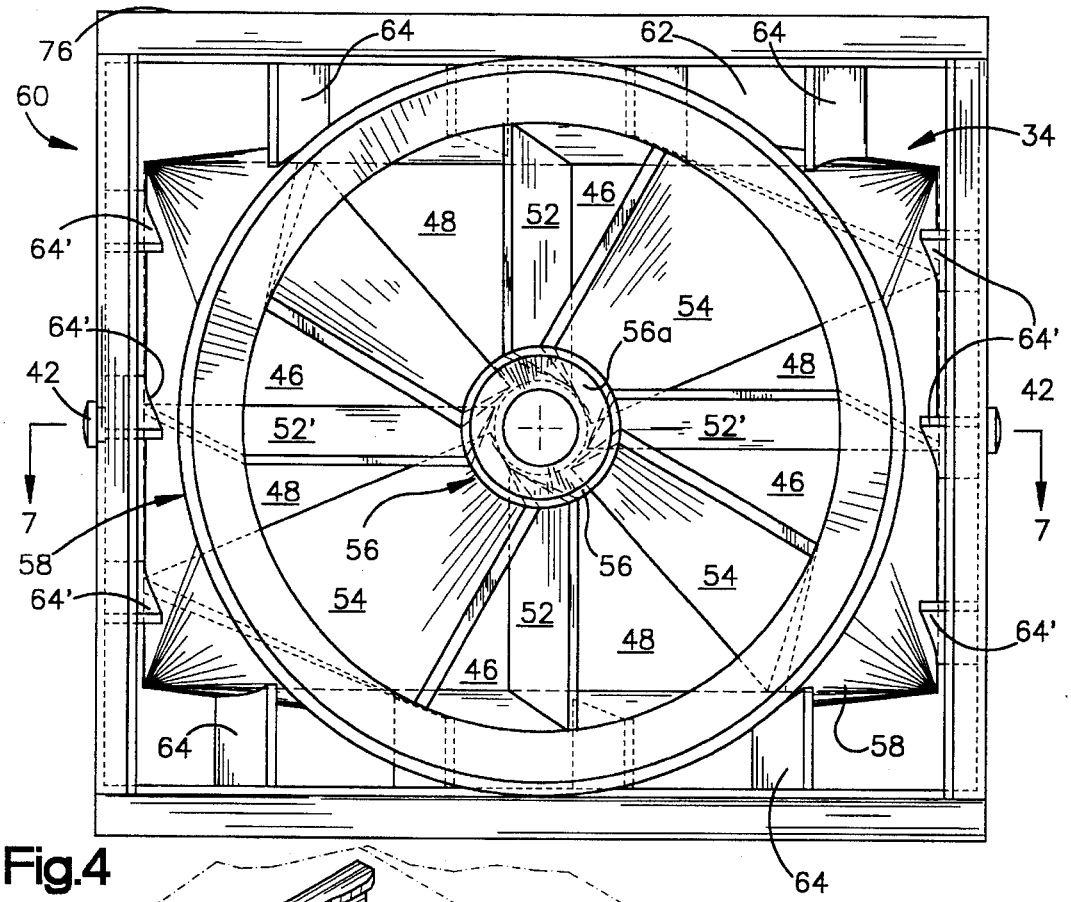
FIG. 4 is an end view of a burner tip forming part of the low nox burner, as seen from the plane indicated by the line 4—4 in FIG. 3.
Figure 5:
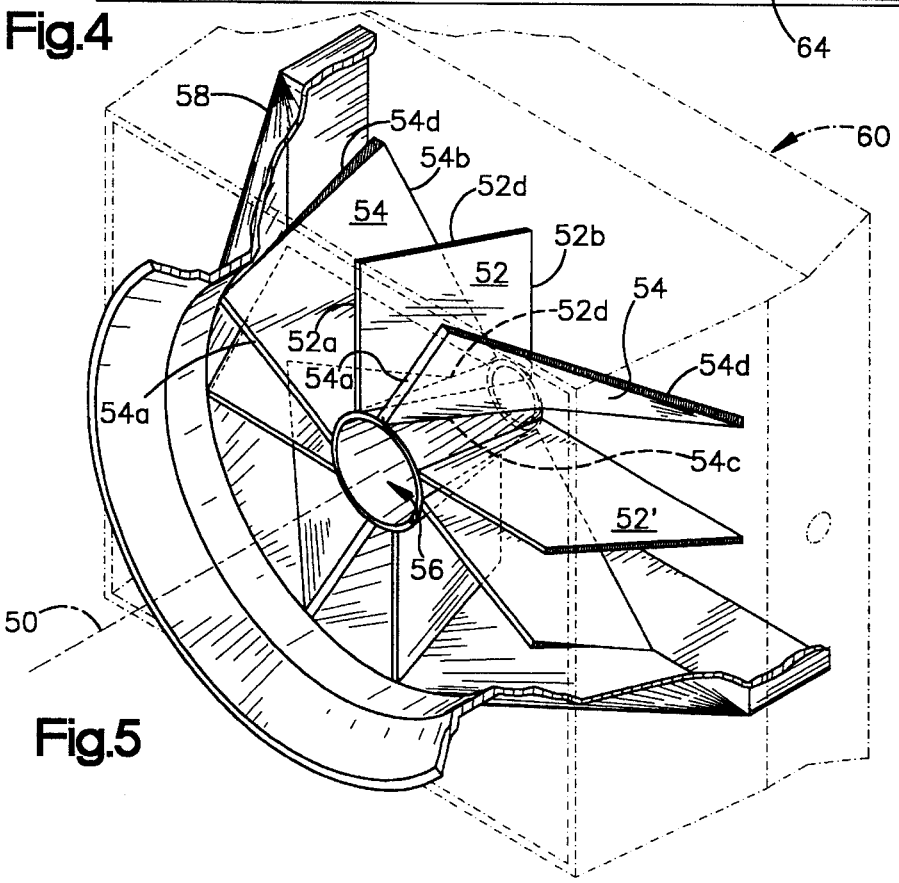
FIG. 5 is a perspective view of the burner tip shown in FIG. 4 with portions broken away to show interior detail.

As seen in FIGS. 4 and 5, the burner tip 34 is rectangular in cross-section at its inner end where it is attached to the conduit member 30. The conduit member 30 includes a transition section 30*a* that connects the inlet 20 to a slightly expanded outlet member 40 to which the burner tip 34 is attached. The cross-section of the conduit member transition section 30*a* changes in shape to accommodate the transition from the circular inlet 20 to the rectangular outlet 40.

The burner tip 34 is pivotally connected to the expanded outlet 40 by a pair of pivot members 42. The pivot members 42 allow the burner tip 34 to rotate on a horizontal axis defined by the pivots, so that the fuel and combustion air injected by the burner tip 34 can be directed upwardly or downwardly with respect to the vertical axis 14 of the combustion chamber 10*a*.

Figure 6:
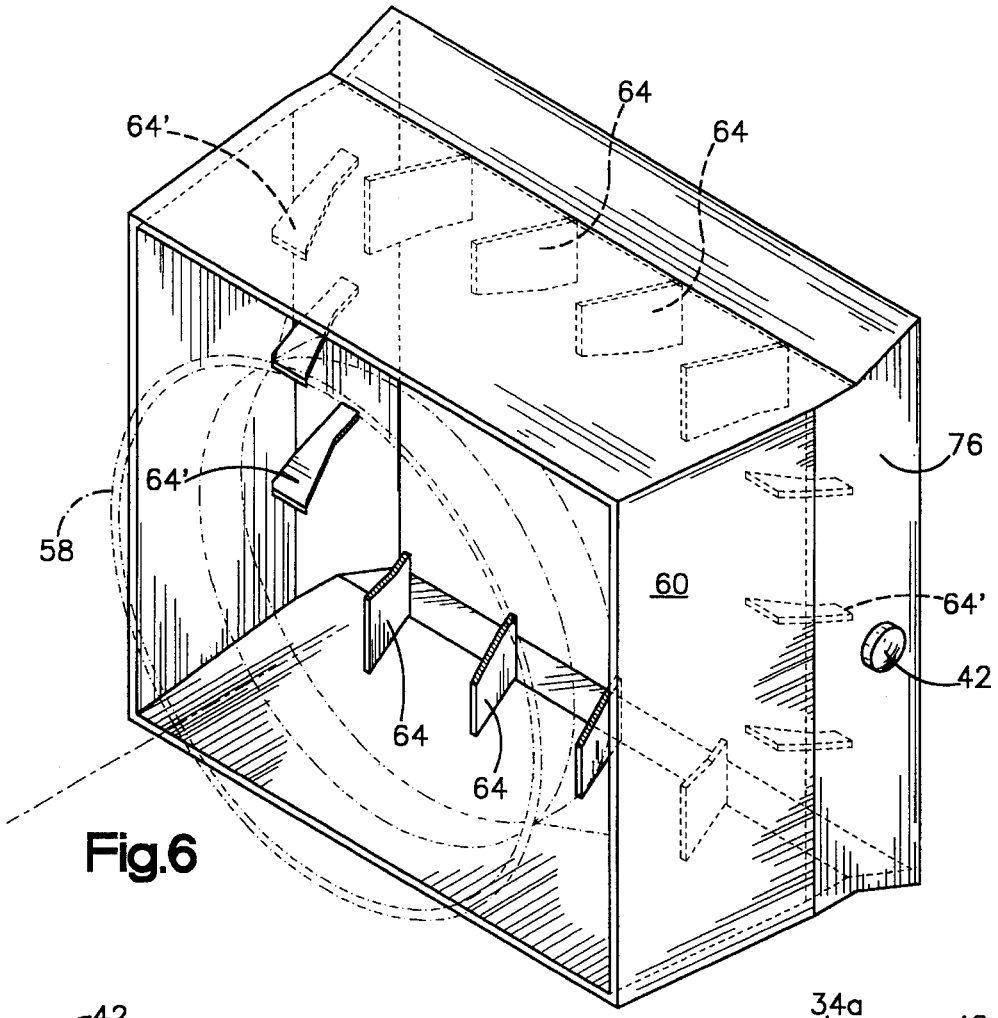
FIG. 6 is another perspective view of the burner tip shown in FIG. 4 with portions removed to show additional details.
Figure 7:
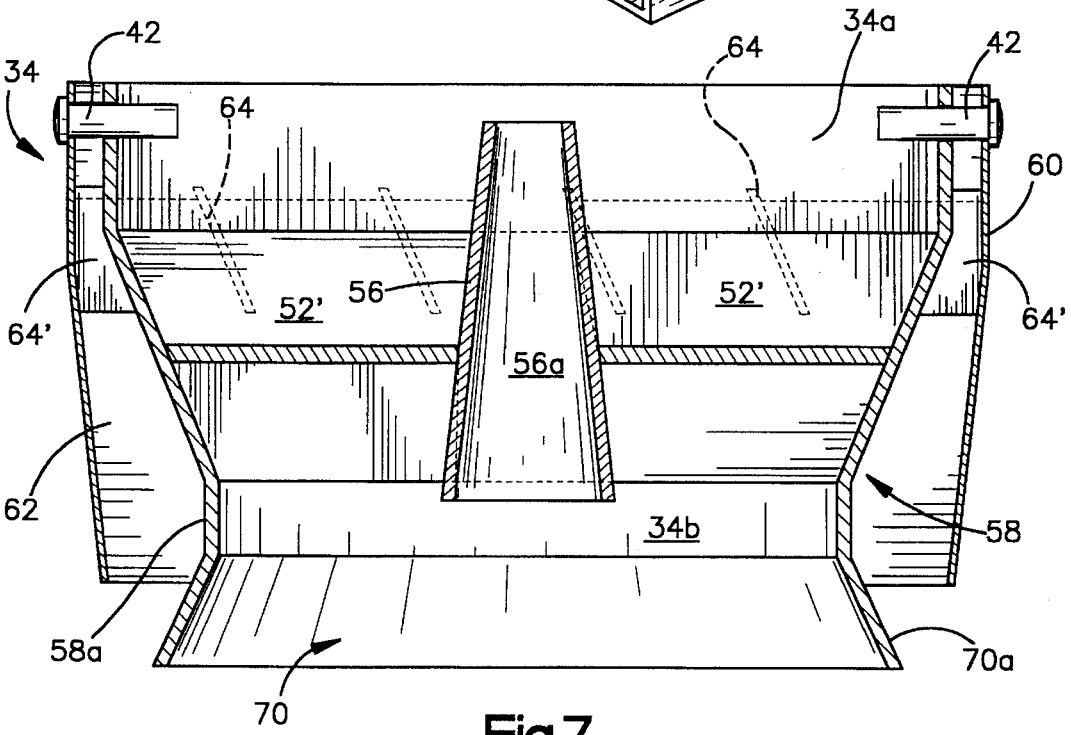
FIG. 7 is a sectional view of the burner tip as seen from the plane indicated by the line 7—7 in FIG. 4.

Referring to FIGS. 4–6, the burner tip 34 produces a plurality of alternating fuel-rich and fuel-lean fuel streams which are all encircled by combustion air. In the preferred and illustrated embodiment, the burner tip 34 defines a plurality of channels 46, 48 (shown best in FIG. 4). During burner operation, the channels 46, 48 create the fuel-rich and fuel-lean streams, respectively. The channels 46, 48 are skewed with respect to a central axis 50 of the burner tip 34 and thereby impart a rotational moment to the streams as they exit the burner tip 34.

In the illustrated embodiment, the channels 46, 48 are defined by first and second blades 52, 54. The blades extend generally radially from a cone member 56 to a fuel stream shroud or fuel guide 58. A combustion air shroud or air guide 60 (shown in phantom in FIG. 5) surrounds the fuel guide 58 and, as seen best in FIG. 6, defines a combustion air channel 62 through which the combustion air flows into the combustion chamber 10*a*.

A plurality of gussets or rib-like vanes 64 are preferably positioned between the outside of the fuel guide 58 and the inside of the air guide 60 to maintain the spatial position between the two members. The ribs rigidize the connection between the air guide 62 and the fuel guide 58, so that they move as a unit about the pivots 42. In addition, the vanes 64, as will be explained, impart a rotational moment to the combustion air travelling through the channel 62.

In the preferred embodiment, the first blade member 52 includes parallel leading and trailing edges 52*a*, 52*b*. A base 52*c* is attached to the cone member 56 as by welding. The first or main blade is preferably planar and defines an angle with respect to the centerline of the burner (or alternately, with respect to an imaginary plane extending through the centerline) of 5° to 8°. A top edge 52*d* is attached, as be welding, to the inside of the fuel shroud 58.

The secondary blades 54 are larger in cross-section than the main blades 52 and each includes a leading edge 54*a* and a trailing edge 54*b* which, in the preferred embodiment, are not parallel. A base 54*c* is attached to the cone member 56, as by welding. A top edge 54*d* is attached to the inside of the fuel guide 58.

In the preferred embodiment, the secondary blade is not planar, but is twisted or skewed. To achieve the skewing, the base 52*c* defines an angle in the range of 15° to 25° with the axis 50 of the burner tip. The top edge 52*d* preferably defines a larger angle in the range of 30° to 35° with respect to the centerline 50 of the burner. As a result, each secondary blades 54 has a slightly twisted configuration.

Fuel-rich and fuel-lean streams are created due to the change in cross-sectional area of the channels 46, 48 defined between adjacent first and second blades 52, 54. The channel 46 is a fuel-rich stream because the cross-section of the space or channel defined between adjacent first and second blades decreases from a burner tip entry 34*a* (see FIG. 6) to the burner tip outlet 34*b*. The channel 48 defined between adjacent main and secondary blades 52, 54, increases in cross-section as the fuel travels from the burner tip entry 34*a* to the burner tip outlet 34*b*.

In the preferred embodiment, the second blades 54 are substantially identical. However, the first blades 52 are dimensionally different due to the overall rectangular shape of the burner tip 34. In particular, the two vertically oriented first blades 52 are identical whereas the laterally-oriented first blades 52' have a larger radial extent to accommodate the lateral dimension of the burner tip which is larger than the vertical dimension. The angles and positioning of the blade 52' with respect to the cone member 56 is substantially identical to that of the blade 52.

As seen best in FIGS. 5 and 6, the cone member 56 tapers outwardly from the burner tip entry 34*a* to the burner tip outlet 34*b*. The arcuate surfaces of the cone exposed between the adjacent main and secondary blades define ramp-up surfaces. It is believed that the arcuate, inclined surface at the base of each channel 46, 48 helps stabilize the flame by producing turbulence in the fuel streams being discharged by the burner tip 34.

As seen best in FIGS. 5 and 6, an expanding nozzle member 70 is positioned at the outlet of the burner tip 34. In particular, and as seen best in FIG. 6, the fuel guide 58 decreases in cross-section as the fuel stream traverses from the inlet 34 towards the outlet 34*b*, into a narrow diameter section indicated by the reference character 58*a*. The expanding nozzle member 70 is connected to and is preferably formed integral with the narrow diameter section 58*a* and is a continuation thereof. The nozzle 70 defines an outwardly expanding deflecting surface 70*a* which tends to deflect the combustion air being discharged through the channel 62, outwardly.

The combustion air discharged and deflected outwardly by the deflecting member 70, tends to provide a zone of combustion air that surrounds the rotating fuel-lean, fuel-rich streams exiting the burner tip.

The combustion air, as indicated above, enters the air housing 36 by way of the opening 36*a*. In the preferred and illustrated embodiment, the vanes 64 (which are positioned between the air guide 60 and the fuel guide 58) define a predetermined angle with respect to a centerline 50 of the burner tip 34. In the preferred embodiment, the vanes 64 define an angle in the range of 10° to 30° with the axis 50 of the burner tip 34 (see FIG. 5). The vanes 64 impart a rotational moment to the combustion air traveling in the air guide channel 62.

As seen best in FIG. 3, the combustion air is received in a converging inlet member 76 forming part of the air guide 60. The overall cross-section of the annular passage defined between the outside of the fuel guide 58 and the air guide 60 decreases, thus increasing the velocity of the combustion air as it travels through the burner tip 34. As indicated above, the combustion air with increased velocity is then deflected outwardly as it exits the burner tip 34.

The channels 46 which converge in cross-section as the pulverized coal stream traverses from the burner tip entry 34*a* to the burner tip outlet 34*b* tend to increase the velocity of the stream. On the other hand, the diverging cross-section of the fuel-lean channels 48 tend to reduce the speed of the fuel-lean stream. As a result, the rotational force imparted to the fuel-rich stream is greater than the rotational force imparted to the fuel-lean stream.

The cone-shaped support member 56, which supports the inner ends of the first and second blade members 52, 54 is also operative to generate a fuel-lean stream. As seen in FIG. 6, the cone-shaped support member 56 defines a passage that expands in cross-section as it traverses from the burner tip inlet 34*a* to the burner tip outlet 34*b*. This expanding cross-section generates a fuel-lean stream that exits the cone-shaped passage 56*a* at a velocity less than it entered. As a result, the burner tip produces a centrally positioned fuel-lean stream surrounded by rotating, alternating fuel-lean, fuel-rich streams which, in turn, are surrounded by rotating combustion air which exits the air guide 60 and is deflected outwardly by the deflecting member 70.

As indicated above, the burner tip 34 is pivotally connected to the burner fuel pipe 30 by the pivots 42. Suitable control mechanisms (not shown) are used to rotate the burner tip 34 upwardly or downwardly to raise or lower the overall position of the fireball in the center of the combustion chamber 10*a* and thus adjust the overall combustion process within the combustion chamber 10*a*.

Figure 8:
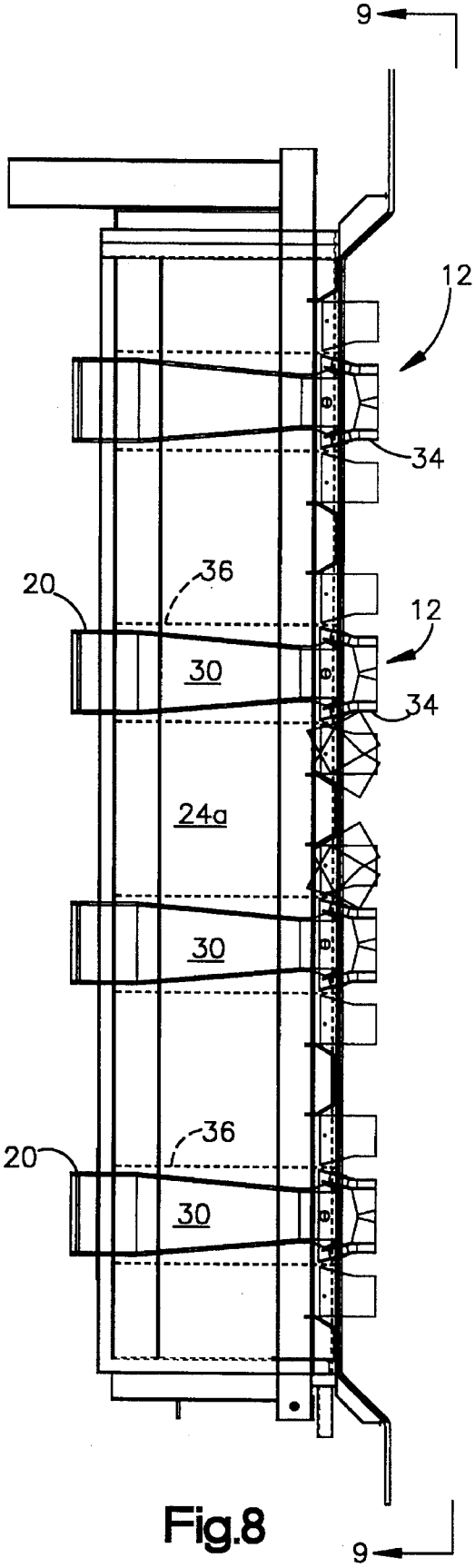
FIG. 8 is a fragmentary elevational view showing an array of burners as they would be mounted in a boiler furnace.
Figure 9:
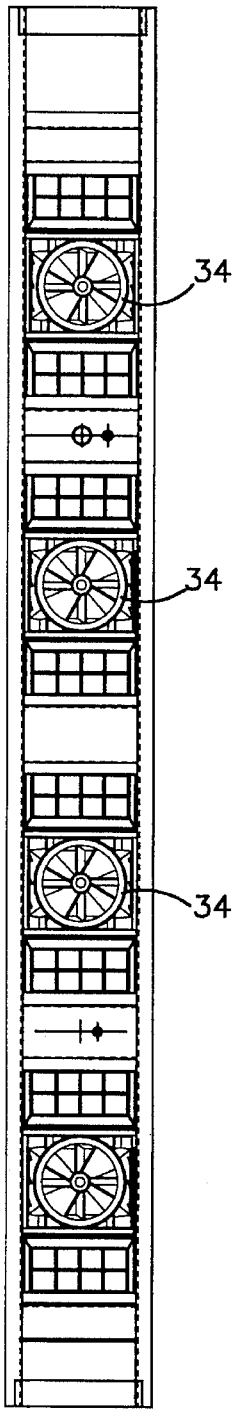
FIG. 9 is an end view as seen from the plane indicated by the line 9—9 in FIG. 8.

As seen in FIGS. 8 and 9, in an actual boiler, a plurality of vertically spaced burners 12 are located in each corner of the combustion chamber 10*a*. The burners 12 receive combustion air from a common windbox 24*a*. Each individual burner includes a tip 34 which can be rotated upwardly and downwardly to make adjustments to the combustion process.

A burner tip embodying the present invention has been built and, at the time of this application, is being tested. In this particular burner, the first blades 52, 52', are arranged at an angle of 5° with respect to the center axis 50 of the burner. For the secondary blades 54, the base 54*c* is arranged at an angle of substantially 20° with respect to the center axis 50, whereas, the top edge 52*d* is arranged at an angle of approximately 30°. The vanes 64 are arranged at an angle of approximately 15° with respect to the center axis 50 of the burner tip 34.

The burner of the present invention provides a means for increasing the burning efficiency while reducing emissions in a tangentially fired boiler. The number of blades and overall configuration of the burner tip is illustrated by way of example. The principles of this invention, however, can be adapted to other types of tangentially fired boilers and should not be limited to the specific configuration illustrated.

Although the invention has been described in detail, it should be understood that those skilled in the art can make various changes, alterations and substitutions to the embodiments described herein without departing from the spirit or scope of the invention which is solely defined by the following claims.

I claim:

1. A burner for combusting pulverized coal in a tangentially fired boiler, comprising:

a) structure defining a fuel passage extending from a source of pulverized coal carried by an air stream to a fluid pressure outlet;

b) structure defining burner outlet communicating with a combustion region for said pulverized coal;

c) a fuel stream dividing unit, near said outlet, for dividing said pulverized coal stream into fuel rich and fuel lean streams, including:

i) a plurality of first blade members, generally radially directed, and circumferentially spaced about a centrally positioned support member and extending between said support member and a peripheral fuel shroud;

ii) second blade members spaced circumferentially about said support member and in an alternating relationship with said first blade members;

iii) said first blade members defining a first angle with respect to an imaginary reference plane extending through a center line of said support member;

iv) said second blade members defining a second angle with respect to an imaginary reference plane extending through said centerline that is greater than said first blade angle, such that a channel diverging in cross-section is defined between a first blade member and an adjacent second blade member and a channel converging in cross-section is defined between said second blade member and a next adjacent first blade member; and d) an air guide positioned around at least a portion of said fuel shroud and defining a passage for combustion air.

2. The burner of claim 1, wherein said fuel stream dividing unit is pivotally attached to said fuel passage outlet.

3. The burner of claim 2, wherein said fuel passage is surrounded by an air housing which defines a substantially annular passage providing a path of movement for combustion air between said fuel passage and an inside of said air housing.

4. The burner of claim 1, wherein said first blade member has a base that defines an angle in the range of 5°–8° with respect to a centerline of said fuel stream dividing unit and said second blade member defines an angle in the range of 15°–25° with respect to said centerline.

5. The burner of claim 4, wherein said first blade member is substantially planar in construction and said second blade member is non-planar.

6. The apparatus of claim 1, wherein said air guide and fuel dividing unit define an integral burner tip that is pivotally attached to said fuel passage outlet and is pivotally movable about a horizontal axis.

7. The apparatus of claim 1 wherein said peripheral fuel shroud includes a portion that converges in cross-section to a narrow diameter segment followed by an expanding outlet portion.

8. The apparatus of claim 7, wherein said expanding outlet portion of said peripheral fuel shroud defines a deflecting surface for combustion air exiting said air guide.

9. The apparatus of claim 1, wherein said centrally positioned support member is cone-shaped and defines an outwardly expanding passage for fuel traveling through said fuel stream dividing unit and further defines arcuate, ramp surfaces between adjacent first and second blade members.

10. The apparatus of claim 1, further comprising rib-like vanes for supporting said air guide with respect to said fuel shroud.

11. The apparatus of claim 10, wherein said vanes define an angle in the range of 10°–30° with respect to a centerline of said fuel stream dividing unit.

12. A low nox burner for use in a tangentially-fired furnace, comprising:

a) a fuel conduit extending from a fuel supply pipe to a conduit outlet;

b) a burner tip, pivotally connected to said fuel conduit outlet and defining a horizontal axis about which said burner tip is pivotally movable with respect to said fuel conduit outlet;

c) said burner tip comprising:

i) a centrally positioned support member:

ii) a plurality of first and second blade members extending from said centrally positioned support member to a fuel guide such that alternating fuel-rich, fuel-lean channels are defined between adjacent first and second blade members;

iii) an air guide surrounding at least a portion of said fuel guide and defining a channel around said fuel guide through which combustion air is conveyed;

iv) said fuel guide defining an entry member for receiving fuel from said conduit outlet.

13. A burner tip for a burner used in a tangentially-fired furnace, comprising:

a) a plurality of first and second blade members extending substantially radially from a centrally positioned support member;

b) a fuel guide surrounding and attached to outer ends of said first and second blade members whereby alternating fuel-rich and fuel-lean channels are defined between said centrally positioned support member and an inside of said fuel guide;

c) an air guide surrounding at least a portion of said fuel guide and defining a passage along which combustion air is conveyed to a burner tip outlet;

d) said first blade member defining a first angle with respect to a centerline of said support member and said second blade member defining a second angle, greater than said first angle with respect to a centerline of said centrally positioned support member.

14. The burner tip of claim 13 wherein said support member is cone-shaped.

15. The burner tip of claim 13 further comprising pivot structure by which said burner tip is pivotally connected to a source of fuel and combustion air.

16. The burner tip of claim 13 wherein said first blade member is substantially planar in configuration and said second blade member is non-planar.

17. The burner tip of claim 13, wherein said first angle is in the range of 5°–8° and said second angle is in the range of 15°–25°.

18. The burner tip of claim 17, wherein said first angle is substantially 5° and said second blade angle is substantially 20°.

19. The burner tip of claim 13, wherein said fuel guide includes a narrow diameter portion, downstream of said first and second blade members which merges with an outlet member that expands in cross-section.

20. The apparatus of claim 19, wherein said outlet member of said fuel guide defines a deflecting surface for combustion air discharged by said air guide.

21. The burner tip of claim 13, further comprising angled vanes for supporting said air guide with respect to said fuel guide in a predetermined spatial position, said vanes operative to impart rotational forces to combustion air traveling between said air guide and said fuel guide.

22. The apparatus of claim 13, wherein said air guide includes a converging inlet member which receives combustion air from an air housing.

23. The burner tip of claim 22, wherein said fuel guide includes a outwardly expanding portion at an outlet side of said fuel guide that is operative to deflect combustion air being discharged by said air guide.

24. A burner tip for a burner used to burn a stream of pulverized coal, comprising:

a) fuel guide and an air guide surrounding at least a portion of said fuel guide;

b) a coal stream dividing assembly located within said fuel guide, said assembly operative to divide a pulverized coal stream into fuel rich and fuel lean streams;

c) said assembly including members defining:

i) a plurality of channels having an expanding cross-section such that an outlet side of said channel has a larger cross-section than an outlet side; and, ii) a plurality of channels interposed between said expanding channels, having a converging cross-section such that an outlet side of said channel has a smaller cross-section than an inlet side of said channel;

iii) a cone-shaped inner support member to which inner ends of said members are attached.

25. The burner tip of claim 24, wherein said cone-shaped support member defines arcuate ramp-like surfaces at bases of said channels which direct said stream in a direction diverging from a center line of said support member.

26. A burner tip for a burner used to burn a stream of pulverized coal, comprising:

a) fuel guide and an air guide surrounding at least a portion of said fuel guide;

b) a coal stream dividing assembly located within said fuel guide, said assembly operative to divide a pulverized coal stream into fuel rich and fuel lean streams;

c) said assembly including members defining:

i) a plurality of channels having an expanding cross-section such that an outlet side of said channel has a larger cross-section than an outlet side; and, ii) a plurality of channels interposed between said expanding channels, having a converging cross-section such that an outlet side of said channel has a smaller cross-section than an inlet side of said channel;

iii) an inner support member to which inner ends of said members are attached;

d) a plurality of vanes positioned between said air guide and said fuel guide and operative to impart a rotational moment to combustion air travelling between said air guide and said fuel guide.

27. The apparatus of claim 26, wherein said vanes are positioned at an angle in the range of 10°–30° with respect to a centerline of said coal stream dividing assembly.

28. The apparatus of claim 26, wherein said vanes define an angle of substantially 15° with respect to a centerline of said coal stream dividing assembly.

* * * * *